US009654886B2

(12) United States Patent
Barth et al.

(10) Patent No.: US 9,654,886 B2
(45) Date of Patent: May 16, 2017

(54) HYBRID HEARING INSTRUMENT CONNECTOR

(71) Applicant: SIVANTOS PTE. LTD., Singapore (SG)

(72) Inventors: Joachim Roland Barth, Nuremberg (DE); Holger Kral, Fuerth (DE); Joseph Sauer, Strullendorf (DE)

(73) Assignee: Sivantos Pte. Ltd., Singapore (SG)

( * ) Notice: Subject to any disclaimer, the term of this patent is extended or adjusted under 35 U.S.C. 154(b) by 675 days.

(21) Appl. No.: 13/928,921

(22) Filed: Jun. 27, 2013

(65) Prior Publication Data

US 2014/0003638 A1 Jan. 2, 2014

(30) Foreign Application Priority Data

Jun. 27, 2012 (DE) ..... 10 2012 210 983

(51) Int. Cl.
*H04R 25/00* (2006.01)

(52) U.S. Cl.
CPC ..... *H04R 25/556* (2013.01); *H04R 25/00* (2013.01); *H04R 25/75* (2013.01)

(58) Field of Classification Search
USPC ..... 381/312, 314, 322, 328, 330, 380, 381, 381/382
See application file for complete search history.

(56) References Cited

U.S. PATENT DOCUMENTS 4,592,370 A * 6/1986 Lee et al. ..... 600/379
7,684,579 B2 3/2010 Ochsenbein et al.
8,379,895 B2 * 2/2013 Gebert et al. ..... 381/322
2008/0095390 A1 4/2008 Gebert et al.
2009/0028356 A1 1/2009 Ambrose et al.
2011/0311069 A1 12/2011 Ambrose et al.
2012/0014549 A1 * 1/2012 Higgins et al. ..... 381/330
2012/0063621 A1 3/2012 Naumann

FOREIGN PATENT DOCUMENTS

CN 101272638 A 9/2008
CN 102404677 A 4/2012
WO 2010089422 A2 8/2010

* cited by examiner

*Primary Examiner* — Ahmad F. Matar
*Assistant Examiner* — Sabrina Diaz
(74) *Attorney, Agent, or Firm* — Laurence A. Greenberg; Werner H. Sterner; Ralph E. Locher

(57) ABSTRACT

A connector-based link is suited to various signals and media for connecting a tube with a hearing instrument, which ensures a reliable mechanical hold, good connection and high tightness and in the process is easy to handle. This is achieved by a connector for a hearing instrument system including a housing which contains a number of connections, and a tube which contains a number of lines, which is embodied to detachably connect a number of lines of the tube to a number of connections of the housing, wherein the connections of the connector contain different spatial orientations. The fact that the connections each have a different spatial orientation brings about a mutual decoupling. As a result, the demands on dimensional stability of the various connections are advantageously reduced since the different connections are not closed in a shared, identical end position.

4 Claims, 2 Drawing Sheets

HYBRID HEARING INSTRUMENT CONNECTOR

CROSS-REFERENCE TO RELATED APPLICATION

This application claims the priority, under 35 U.S.C. §119, of German application DE 10 2012 210 983.8, filed Jun. 27, 2012; the prior application is herewith incorporated by reference in its entirety.

BACKGROUND OF THE INVENTION

Field of the Invention

The invention relates to a hybrid hearing instrument connector. A connector is understood here to mean a connection, for instance a plug-in connection, for attaching a receiver tube or sound tube to a hearing instrument housing. The term hybrid is understood here to mean that various kinds of connections are established.

Hearing instruments can be embodied for instance as hearing devices. A hearing device is used to supply a hearing-impaired person with acoustic ambient signals, which are processed and amplified so as to compensate for and/or treat the respective hearing impairment. It consists in principle of one or a number of input transducers, a signal processing facility, an amplification facility and an output transducer. The input transducer is generally a sound receiver, e.g. microphone, and/or an electromagnetic receiver, e.g. an induction coil. The output transducer is generally realized as an electroacoustic converter, e.g. miniature loudspeaker, or as an electromechanical converter, e.g. bone conduction earpiece. It is also referred to as an earpiece or receiver. The output transducer generates output signals, which are routed to the ear of the patient and are to generate a hearing perception in the patient. The amplifier is generally integrated in the signal processing facility. Power is supplied to the hearing device by a battery integrated in the hearing device housing. The essential components of a hearing device are generally arranged on a printed circuit board as a circuit carrier and/or connected thereto.

Aside from hearing devices, hearing instruments can also be embodied as so-called tinnitus maskers. Tinnitus maskers are used to treat tinnitus patients. They generate acoustic output signals which depend on the respective hearing impairment and depending on the active principle also on ambient noises, the output signals possibly contributing to reducing the perception of interfering tinnitus noises or other ear noises.

Hearing instruments can furthermore also be embodied as telephones, cell phones, headsets, earphones, MP3 players or other telecommunication or consumer electronics systems.

The term hearing instrument should be understood below to include both hearing devices, and also tinnitus maskers, comparable devices of this type and telecommunication and consumer electronics systems.

Hearing instruments, in particular hearing devices, are known in various basic types. With in-the-ear (ITE) hearing devices, a housing containing all functional components including a microphone and a receiver is worn at least partially in the auditory canal. Completely-in-canal (CIC) hearing devices are similar to the ITE hearing devices, but are however worn completely in the auditory canal. With behind-the-ear (BTE) hearing devices, a housing with components such as a battery and a signal processing facility is worn behind the ear and a flexible sound tube, or simply tube, routes the acoustic output signals of a receiver from the housing to the auditory canal, where an earpiece is frequently provided on the tube for the reliable positioning of the tube end in the auditory canal. Receiver-in-canal behind-the-ear (RIC-BTE) hearing devices are similar to BTE hearing devices, but the receiver is however worn in the auditory canal and instead of a sound tube, a flexible earpiece tube routes electrical signals, instead of acoustic signals, to the receiver, which is attached to the front of the earpiece tube, in most instances in an earpiece used for reliable positioning in the auditory canal. RIC-BTE hearing devices are frequently used as so-called open-fit devices, in which in order to reduce the interfering occlusion effect, the auditory canal remains open for the passage of sound and air.

Deep-fit hearing devices are similar to CIC hearing devices. While CIC hearing devices are nevertheless generally worn in the outer part of the outer auditory canal, deep-fit hearing devices are moved further toward the eardrum and worn at least partially in the inner part of the outer auditory canal. The outer (distal) auditory canal is a channel lined with skin and connects the auricle with the eardrum. In the outer part of the auditory canal, which attaches directly to the auricle, this channel is formed from elastic cartilage. In the inner (proximal) part, the channel is formed of temporal bone and thus consists of bones. The course of the auditory canal between the cartilaginous and bony part is generally angled and describes an angle which differs from person to person. In particular, the bony part of the auditory canal is relatively sensitive to pressure and touch. Deep-fit hearing devices are worn at least partially in the sensitive bony part of the auditory canal. When moving into the bony part of the auditory canal, the mentioned angulation must also take place, which may be difficult depending on the angle. Furthermore, small diameters and meandering shapes of the auditory canal can further hamper the movement.

In hearing instruments containing an earpiece (also ear tip), a tube-type connection (tube) is generally provided between the housing of the hearing instrument and the earpiece. The tube-type connection can be embodied for instance so as to route sound from a receiver in the housing to the earpiece in a BTE hearing instrument, or electrical signals to a receiver arranged on the earpiece in a RIC-BTE hearing instrument. The earpiece, tube and housing are generally designed such that the earpiece is positioned and held in a desired position in the auditory canal. With RIC-BTE hearing instruments, it is inter alia frequently deemed to be desirable for a receiver arranged on the earpiece not to be in direct contact with the auditory canal wall. The position of the earpiece in the auditory canal, particularly with RIC-BTE hearing instruments, has a significant influence on essential acoustic properties, such as for instance the appearance of the unwanted occlusion effect. Not least therefore, a secure and permanent positioning of the earpiece is of particular interest.

In addition to elastic earpieces made of a flexible material, expandable and self-expanding earpieces are also known, (so-called inflatable earpiece). An expandable earpiece can ensure a secure hold and furthermore, if required, also a high degree of tightness against the passage of ambient sound and ambient air. A known mechanism for expanding earpieces is based on the use of a balloon (Balloon Inflatable Earpiece). The balloon can be expanded with various means, in the simplest case with ambient air. The supply of expansion pressure to the balloon can take place by way of a corresponding pressure line in the tube, which is connected to a pump in the housing of the hearing instrument.

In addition to transmitting electrical and acoustic signals and expansion media, a tube can also be used to transmit other signals and media. For instance, an air line to attach a fan and/or ventilate a receiver or a vent can be provided in the tube for instance or an optical fiber can be provided for signal transmission purposes.

The tube and hearing instrument housing are generally connected by way of a plug-in connection. The plug-in connection has the function of producing the electrical and/or other connections, as well as ensuring a mechanical hold. Furthermore, the plug-in connection must, particularly in hearing instruments which are frequently exposed unprotected to ambient influences and environmental influences, be tight against the penetration of moisture and dirt. When using balloon-expandable earpieces, a tight connection of the pressure line to the earpiece is possibly also necessary.

U.S. patent publication No. 2011/0311069 A1 discloses a hearing instrument with a balloon-expandable earpiece. A housing to be worn outside of the auditory canal is connected to an earpiece by a tube. Electrical signals and the expansion pressure required to expand the balloon are routed from the housing to the earpiece by way of the tube.

BRIEF SUMMARY OF THE INVENTION

It is accordingly an object of the invention to provide a hybrid hearing instrument connector which overcomes the above-mentioned disadvantages of the prior art devices of this general type, which specifies a connector connection which is suited to various types of signals and media for connecting a tube to a hearing instrument, which ensures a reliable mechanical hold, good connection and a high degree of tightness and is in this way easy to manage.

The invention achieves the object by a hearing instrument system, a connector connection and a tube and a hearing instrument housing having the features of the independent claims.

A basic idea of the invention consists in a hearing instrument system including a housing, containing several connections, and a tube, containing several lines, wherein the tube can be detachably connected to the housing by a connector, which can be embodied for instance as a plug-in connector, and wherein the connector is embodied to connect a number of lines of the tube in a detachable manner to a number of connections of the housing. The connections contain various spatial orientations.

The fact that the connections each contain different spatial orientations brings about a mutual decoupling. As result, the requirements in terms of stability of the various connections are advantageously reduced since the various connections are not connected in a mutual, identical end position. Advantageously the connector can be embodied such that a first connection is first connected by a sliding movement and only then does a second connection exists through a movement oriented at right angles to the sliding movement; the transverse movement can exist for instance in a rotation or pivot movement about the already connected first connection. As a result, a decoupling of the movement when connecting the connections is additionally also achieved. The arrangement of the connections further enables a smaller installation size, by the connections not being arranged adjacent to one another in one surface, but instead being able to be arranged flexibly.

An advantageous embodiment consists in the housing containing at least one first connection and the tube containing at least one first line for a liquid or gaseous medium and in the first connection having a first spatial orientation and in a second connection having a second spatial orientation which differs from the first. The second connection may be an electrical connection for instance.

As a result, the decoupling mentioned previously is used to arrange the connection for the medium on a separate position, which is separately matched to the special requirements of this connection. One particular requirement of this connection is the tightness, so that the position in question above all assists with establishing a tight connection. The connector connection can thus be configured such that high density requirements are first fulfilled for the liquid or gas connection and that only then are further requirements of further connections taken into account.

A further advantageous embodiment consists in the first connection having a flexible, elastic seal.

The elasticity brings about good tightness in a known manner. Furthermore, flexibility and elasticity nevertheless assist in a special way in closing the connector connection with two differently directed part movements. After connecting the first connection to the first part movement, the second part movement can namely take place with a low deformation of the seal by using the flexibility.

A further advantageous embodiment consists in a tube for connection to a hearing instrument housing, which is embodied so as to be used in a hearing instrument system as described above. The tube has a plug with several connections and the connections are arranged on various sides of the plug. The arrangement of connections on various sides of the plug advantageously assists with the plug-in connection described above.

Other features which are considered as characteristic for the invention are set forth in the appended claims.

Although the invention is illustrated and described herein as embodied in a hybrid hearing instrument connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
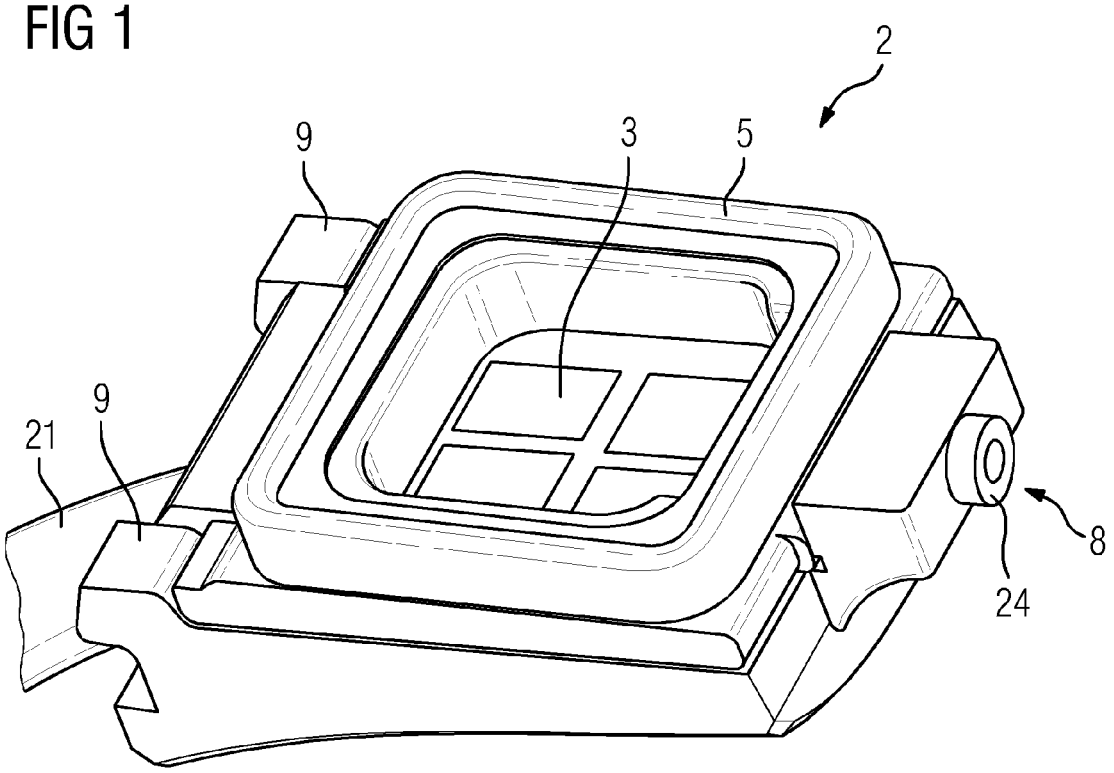
FIG. 1 is a diagrammatic, perspective view of a tube with a plug according to the invention.

Referring now to the figures of the drawing in detail and first, particularly, to FIG. 1 thereof, there is shown a perspective view of a tube 21 with a plug 2 for a hearing instrument system. The plug 2 is part of a connector embodied as a plug-in connection. The tube 21 has electrical lines (which cannot be seen) and a line for a liquid or gaseous medium.

The plug 2 has holding lugs 9 which are used to lock a plug-in connection. A seal 5 protects electrical connections 3 against moisture and dirt. The connections 3 are connected to the corresponding lines in the tube 21.

Furthermore, a pressure connection 8 for a liquid or gaseous medium is provided, which is likewise connected to the corresponding line in the tube 21. The pressure connection 8 contains its own seal 24, which protects on the one hand against dirt and moisture and is on the other hand pressure-tight. It is also embodied as a holding lug.

The pressure connection 8 and the electrical connections 3 are arranged on different sides of the plug 2.

Figure 2:
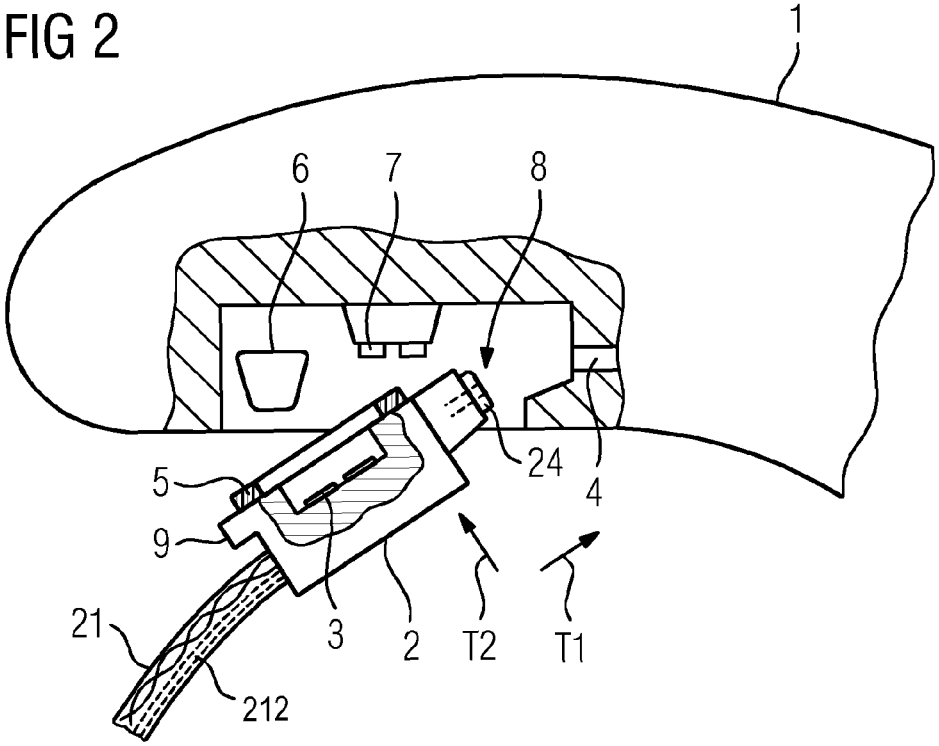
FIG. 2 is a partial, sectional view showing a self-engaging plug-in connection.

As a connector connection, FIG. 2 shows a schematic representation of a self-engaging plug-in connection between the plug 2 described above and a hearing instrument housing 1. Electrical lines and a further line 212 for a liquid or gaseous medium are indicated schematically in the tube 21.

An opening for placing and/or inserting the plug 2 is provided in the housing 1. A depression (right in the FIG. 2), in which the pressure connection 24 formed as a holding lug has to be inserted, is located in the opening.

A bolt 6 is also provided in the opening, the bolt engaging mutually with the holding lugs 9 of the plug 2 if the plug-in connection is closed. The bolt 6 is mounted elastically so that during insertion of the plug 2, it is first displaced by the holding lug 9 and then snaps in place behind the same.

The bolt 6 and the holding lugs 9 together with the pressure connection 24 and the associated depression in this way form a self-engaging connection.

Further electrical connections 7 are provided in the opening, which can be used for instance to transmit receiver signals of the hearing instrument. A pressure connection 4 is used to transmit a liquid or gaseous medium, which can be used for instance to transmit pressure so as to expand a balloon earpiece.

Upon insertion of the plug 2, the pressure connection 24 formed as a holding lug 24 must first be inserted into the corresponding depression. Here it is connected with the pressure connection 4 on the housing side and thus the connection for the gaseous or liquid medium is closed. The movement which the plug has to execute is indicated in FIG. 2 by arrow T1. This is the first part-movement when connecting the connections.

The plug 2 must be rotated and/or pivoted about the already connected pressure connection such that the electrical connections 3 are connected to the connections 7 on the housing side. Here the seal 5 is applied in a sealing fashion to the opening in the housing 1. The rotation and/or pivot movement is as a result simplified such that the pressure connection is based on the flexible seal 24. It is indicated in FIG. 2 by an arrow T2. This is the second part movement when connecting the connections.

Figure 3:
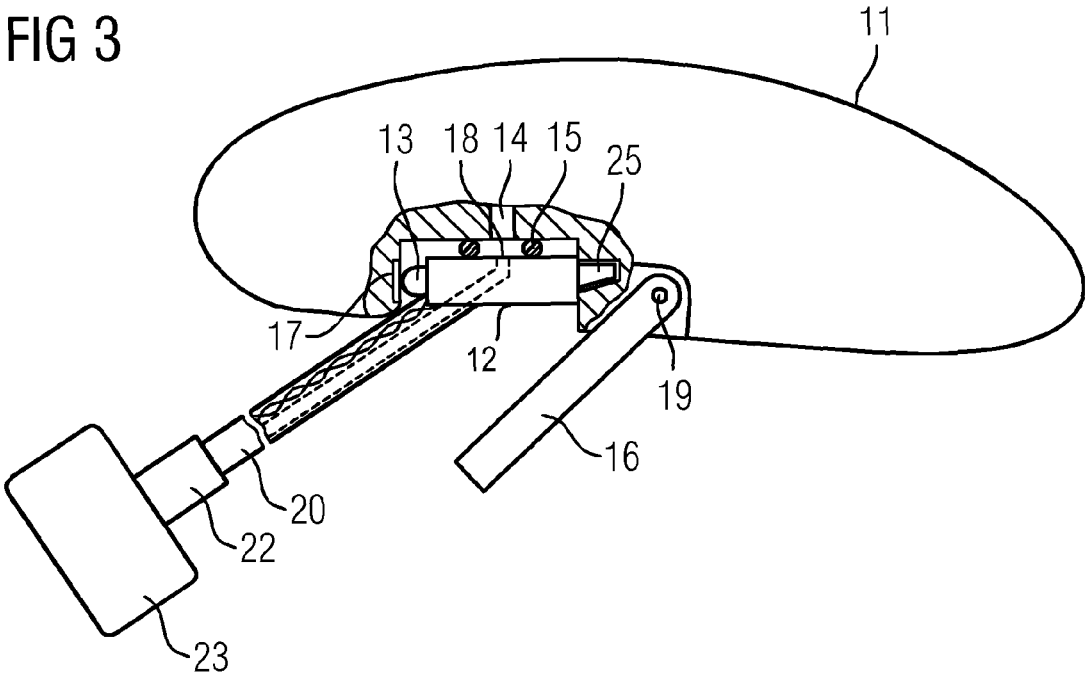
FIG. 3 is a partial, sectional view showing a plug-in connection with a bolt.

FIG. 3 shows a schematic representation of a hearing instrument system having a connector embodied as a plug-in connection with additionally a cover 16 acting as a lock. The housing 11 contains an opening for inserting the plug 12. Electrical connections 17 and a pressure connection 14 are arranged in the opening. Furthermore, the housing contains an axis 19 in order to be able to pivot the cover 16 there around so as to cover and lock the plug-in connection.

The plug 12 is connected to a tube 20. An earpiece 22 is arranged on the other end of the tube 20. A non-illustrated receiver is arranged in the earpiece 22. The earpiece 22 has a balloon 23, which can be expanded by a liquid or gaseous medium. The liquid or gaseous medium is transmitted with the pressure required by the tube 20 for expansion.

The plug 12 has a holding lug 25, with which it must first be introduced into the corresponding depression upon insertion into the opening of the housing 11. It is then completely inserted into the opening with a rotation and/or pivot movement about the holding lug 25. The pressure connection 18 is in this way connected to the pressure connection 14 on the housing side and the seal 15 is pressed.

The electrical connection 13 is in this way connected to the electrical connection 17 on the housing side simultaneously with the connection of the pressure connection. In order not to hamper the movement of the plug 12 upon insertion, the electrical connections 13, 17 are embodied such that they can slide one above the other without resistance as much as possible, for instance with a rounded or rising leading edge in each instance. In addition, one or both electrical connections 13, 17 can be embodied elastically, for instance as a spring contact or Pogo pin. The insertion of the plug is facilitated on the one hand by the use of an elastic spring contact, on the other hand the requirements for the precise dimensional accuracy of the plug are further reduced since deviations can be compensated by the elasticity.

As soon as the plug 12 is inserted completely into the opening of the housing 11, the pressure connection and the electrical connection are therefore also automatically connected. In order to fix the plug 12 in the housing 11 and thus to lock the plug-in connection, the cover 16 is closed. It contains a non-illustrated locking mechanism which prevents an unintentional opening. The closed cover 16 pushes the plug 12 into the opening such that the pressure connection 14, 18 is closed and the seal 15 is pressed and the electrical connection 13, 17 is closed. This simultaneously protects against dirt and moisture. In order to improve the protection, a non-illustrated seal can be arranged between the cover 16 and the housing 11.

A basic idea of the invention can be summarized as follows: the invention relates to a hybrid hearing instrument connector. Connector is understood here to mean a connection, for instance plug-in connection, for attaching a receiver tube or sound tube to a hearing instrument housing. Hybrid is understood here to mean that various connections are established. The object of the invention consists in specifying a connector connection which is suited to various signals and media for connecting a tube with a hearing instrument, which ensures a reliable mechanical hold, good connection and high degree of tightness and in the process is easy to handle. The invention achieves this object by a connector for a hearing instrument system including a housing 1, 11, which contains a number of connections 4,7,14,17, and a tube 21,22, which contains a number of lines, which is embodied to detachably connect a number of lines of the tube 21, 22 to a number of connections 4,7,14,17 of the housing, wherein the connections 4,7,14,17 of the connector contains different spatial orientations. The fact that the connections each contain different spatial orientation brings about a mutual decoupling. As a result, the demands on dimensional stability of the various connections are advantageously reduced since the different connections are not closed in a shared, identical end position.

The invention claimed is:

1. A hearing instrument system, comprising:

a housing having a plurality of connections including a fluid connection and an electrical connection disposed with mutually different spatial orientations;

a tube having a plurality of lines; and a connector configured for detachably connecting said tube to said housing, said connector detachably connecting each of said plurality of lines of said tube to a respective matching one of said plurality of connections.

2. The hearing instrument system according to claim 1, wherein said fluid connection includes a flexible, elastic seal.

3. A tube system for connection to a hearing instrument housing embodied for use in a hearing instrument system, the tube system comprising:

a tube having a plurality of lines and a plug with a plurality of connections including a fluid connection and an electrical connection disposed on mutually different sides of said plug.

4. A hearing instrument housing system for a hearing instrument system containing a tube having a plurality of lines, and a connector, the hearing instrument housing system comprising:

a housing body having a plurality of connections for the tube including a fluid connection and an electrical connection disposed with mutually different spatial orientations, the tube being detachably connected to said housing body by the connector, the connector detachably connecting each of the plurality of lines of the tube to a respective matching one of said plurality of connections of said housing body.

* * * * *